US005307867A

United States Patent [19]

Yasuda et al.

[11] Patent Number: 5,307,867

[45] Date of Patent: May 3, 1994

[54] HEAT EXCHANGER

[75] Inventors: Masayuki Yasuda; Katsuhiro Kano; Tsutomu Ueda, all of Nagoya, Japan

[73] Assignee: Noritake Co., Limited, Nagoya, Japan

[21] Appl. No.: 926,434

[22] Filed: Aug. 10, 1992

[51] Int. Cl.[5] ..... F28F 13/12

[52] U.S. Cl. ..... 165/109.1; 165/174; 138/38; 366/338; 366/339

[58] Field of Search ..... 165/109.1; 366/338, 366/339; 138/38

[56] References Cited

U.S. PATENT DOCUMENTS 2,852,042 9/1958 Lynn ..... 165/109.1
3,985,165 10/1976 Tamir et al. ..... 336/339
4,466,741 8/1984 Kojima ..... 336/339

FOREIGN PATENT DOCUMENTS 3-204592 9/1991 Japan .

OTHER PUBLICATIONS

"Mixer With No Moving Parts To Make Big Impact In Europe", *Process Engineering*, Sep. 11, 1970.

*Primary Examiner*—Albert W. Davis, Jr.
*Attorney, Agent, or Firm*—Fish & Richardson

[57] ABSTRACT

A heat exchanger comprising an outer tube, one or more inner tubes disposed with interstice within said outer tube, and a spiral element extending longitudinally within said inner tube(s). The spiral element is made up of a plurality of unit elements connected together with a connection angle of 0°. Each of the unit elements has a twist angle of 180°, with the direction of twist being reversed from one to a neighboring unit element. Channeling phenomenon is effectively avoided. Heat exchange medium with Rheynolds number $Re > 10^4$ is suitable.

9 Claims, 11 Drawing Sheets

FIR. 7

HEAT EXCHANGER

BACKGROUND

1. Field of the Invention

This invention relates to a heat exchanger comprised of an inner tube fitted with a spiral member therein, and an outer tube, and in which heat exchange of fluid, above all, liquid, is carried out between the inner and outer tubes.

2. Related Art and Problem

It has been known with conventional heat exchangers to provide a large number of heat transfer fins and baffle plates to improve the heat transfer rate. However, with this type of heat exchangers, so-called channeling phenomenon in which the fluid flows as a laminar flow, is produced, thereby placing limitation in improving the heat exchange performance.

It has also been known to use a so-called static mixer in which baffle plates with a twist of 180° are alternately connected to one another in an inverse direction each with a connection angle of 90°. However, the structure tends to be complicated due to the increased number of interconnections, and a large number of process steps are required in production. This presents a grave problem if it is necessary to provide a large number of the inner tubes or to provide a large heat transfer area with the use of an elongated tube. Besides, the conventional static mixer undergoes considerable pressure loss and hence is not satisfactory from the viewpoint of energy saving.

SUMMARY OF THE DISCLOSURE

There is much to be desired in the art to further improve the heat exchanger of the type aforementioned.

Accordingly, it is an objective of the present invention to provide a novel heat exchanger which is freed from the above disadvantages in the conventional art.

For solving the above problem, a heat exchanger having heat transfer characteristics at least comparable to those of the conventional heat exchanger employing a static mixer and yet freed from the above disadvantages is provided.

Namely, the present invention provides a heat exchanger tube comprising a spiral element extending longitudinally within a tube, characterized in that the spiral element is made up of a plurality of unit elements connected together each with a connection angle of 0°, each of said unit elements having a twist angle of 180°, and that the direction of twist is reversed between two neighboring unit elements.

The main part of the heat exchanger may be made up by mounting one or more of the above-defined tubes as inner tube(s) within an outer tube with an air gap in-between.

As will become evident from test results as later described, heat transfer effects comparable to those obtained with the conventional heat exchanger employing a static mixer may be achieved with a structure simpler than that of the conventional heat exchanger. Besides, the pressure loss is markedly low in a manner desirable from the viewpoint of energy saving. These effects are outstanding with low viscosity liquids or with heat exchangers employing an elongated heat exchange tube.

PREFERRED EMBODIMENTS

The present invention is most effective with a heat exchange medium which is liquid, above all, a low viscosity liquid with $Re > 10_4$, such as water. Difficulty otherwise produced with liquids at the time of heat exchange, that is, the channeling phenomenon, may be substantially eliminated.

The spiral element is preferably connected by brazing to the inner wall of the tube in view of ease in connection and the high heat transfer efficiency which may be achieved with this manner of connection. Besides, this manner of connection leads to a reinforced inner wall structure so that the inner wall suffers flexture to a lesser extent even when its thickness is reduced, and hence the heat transfer efficiency may be increased correspondingly.

The effect of inverse twist agitation is produced by the above-mentioned spiral element.

The number of unit elements making up one spiral element may be arbitrarily selected, depending on use and application. The spiral elements may be prepared by first producing the unit elements and welding or brazing the unit elements together, or by producing an integral structure from the outset.

The ratio of the longitudinal length L of each unit element (with a twist angle of 180°) to the inner diameter D of the inner tube, or the ratio L/D, is preferably in a range of from 1 to 3, as in the case of the unit elements of the conventional static mixer.

BRIEF DESCRIPTION OF THE DRAWINGS

FIGS. 1A, 1B and 1C are cross-sectional side elevational views showing the structure of a tube (inner tube), wherein FIG. 1A shows a tube according to the embodiment of the present invention, FIG. 1B a tube according to the Comparative Example and FIG. 1C an empty tube not having any element.

FIG. 2-1 is a cross-sectional side elevational view showing the heat exchanger of the embodiment of the invention, with a cross-sectional view FIG. 2-2 taken along line C—C of FIG. 2-1, which views are the same as those of the comparative embodiment and the empty tube, except the elements.

EXAMPLES

Figure 1A:
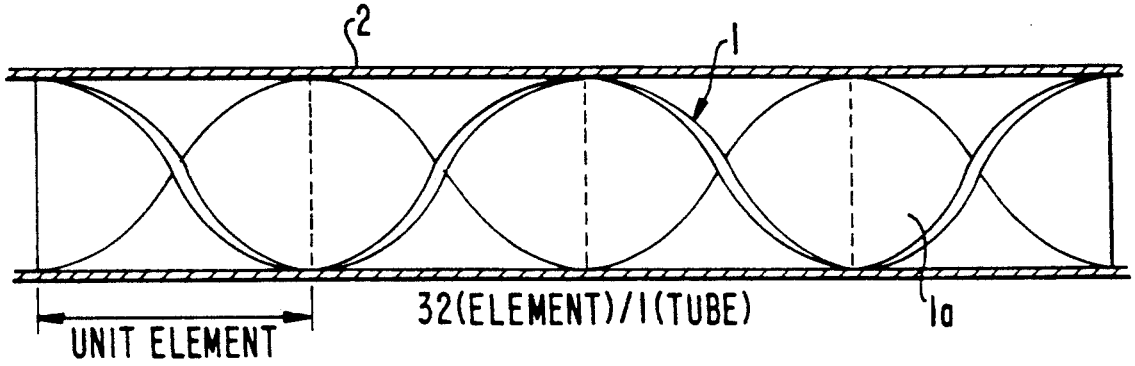
Figure 1B:
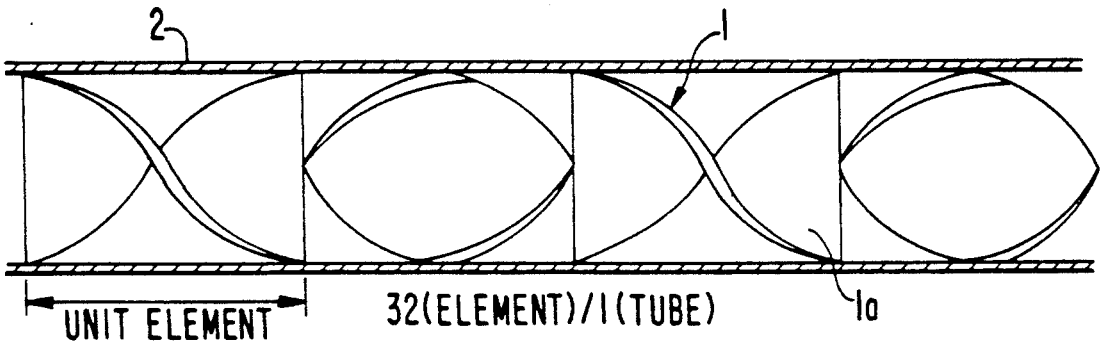
FIG. 1B PRIOR ART

A spiral element 1 of the present embodiment is shown in FIG. 1A. The spiral element 1 is made up of a plurality of, herein four, unit elements 1*a*, . . . each having a twist angle of 180°. The unit elements are connected to one another with a connection angle of 0° with an inversed twist direction from one unit element to another neighboring unit element. In this manner, the spiral element 1 is present as a sole continuous spiral sheet extending longitudinally within a tube, in complete contradistinction from unit elements of a typical conventional static mixer which are discontinuously connected to one another with a connection angle of say 90° (FIG. 1B).

Thus, when mounted within the tube, the spiral element 1 of the present embodiment simply divides the inside of the tube into two channels.

Depending on the type of liquid and the pressure exerted by a liquid flowing within an inner tube, the spiral elements 1, that is, the unit elements 1*a* ff. are formed of a material preferably exhibiting a satisfactory thermal conductivity, such as metal, e.g., SS41, SUS316, Cu or Ni, or ceramics, such as silicon carbide. The spiral elements 1 are integrally brazed to the inner wall of the inner tube.

Figure 1C:
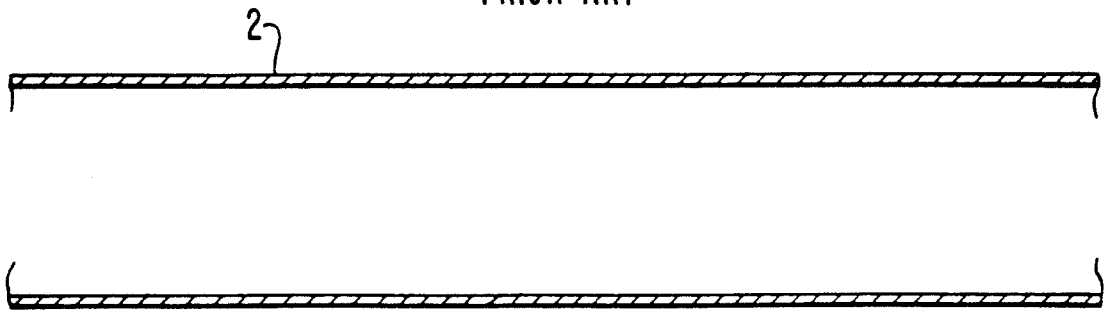
FIG. 1C PRIOR ART
Figure 2A:
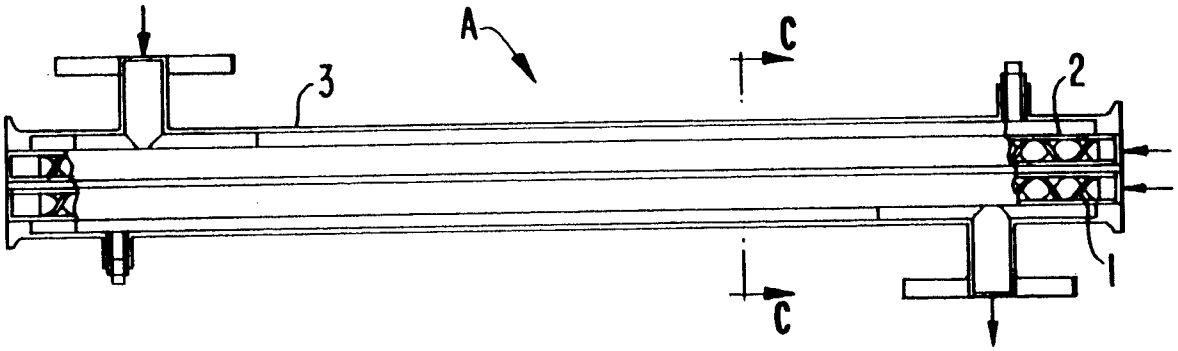
Figure 2B:
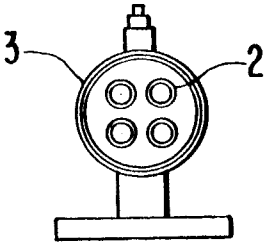

A heat exchanger A having the spiral element 1 is shown in FIG. 2-1, in which 2 denotes an inner tube and 3 an outer tube. The heat exchanger shown herein (FIG. 2-2) is provided with four inner tubes 2.

If a liquid to be heat-exchanged is introduced in the arrow direction into the above-described heat exchanger A, the liquid flow is divided in two channels, in each of which the liquid proceeds in the longitudinal direction as it performs a spiral movement imparted by the unit elements 1*a* with the reverse twist in the spiral movement from one element 1 to another.

TESTS

(1) Objective

The objective of the present test is to confirm the properties of a heat exchanger used in the present Embodiment. As a Comparative Example, a heat exchanger provided with a conventional standard element (FIG. 1B) was used. For reference, a heat exchanger having an empty tube (FIG. 1C) was also tested.

(2) Test Apparatus and Test Method

Figure 3:
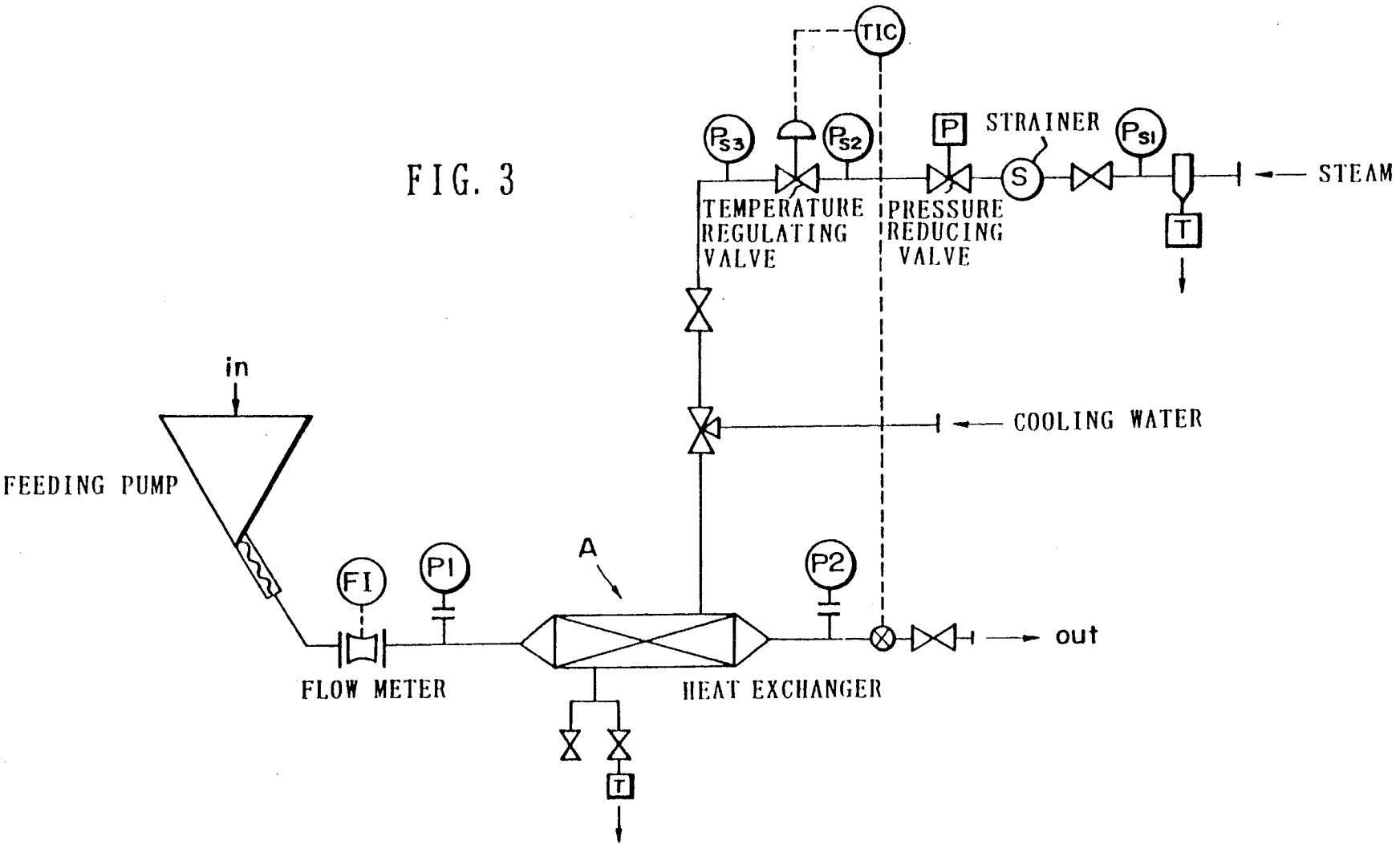
FIG. 3 is a heat exchange flow diagram used for the test.

FIG. 3 shows a heat-exchange flow diagram employed in the test. In FIG. 3, FI denotes a flow rate indicator, P (P1, P2) pressure gauges, $P_s$ ($P_{s1}$, $P_{s2}$, $P_{s3}$) steam pressure gauges, and TIC a temperature indicating/adjusting controler. Legends for the remaining members are shown on FIG. 3. Namely, a heat exchange medium (cooling water or steam for heating) is supplied to the outer tube of the heat exchanger, while a liquid to be heat-exchanged is fed into the inner tube in a counterflow. Table 1 shows heat exchanger specifications. Meanwhile, the spiral element has an overall length L of 810 mm.

As samples, water and acid-saccharized starch syrup (Sun-Syrup 85), manufactured by NIPPON CORN STARCH CO., LTD., adjusted to a concentration of 75%, were used as a low-viscosity liquid and as a high-viscosity liquid, respectively. The physical properties of the samples are shown in Table 2.

Pressure losses were measured, while heating tests by steam and cooling tests by tap water were also conducted.

(3) Test Results (3-1) Pressure Losses by Low-Viscosity Liquid

Figure 6:
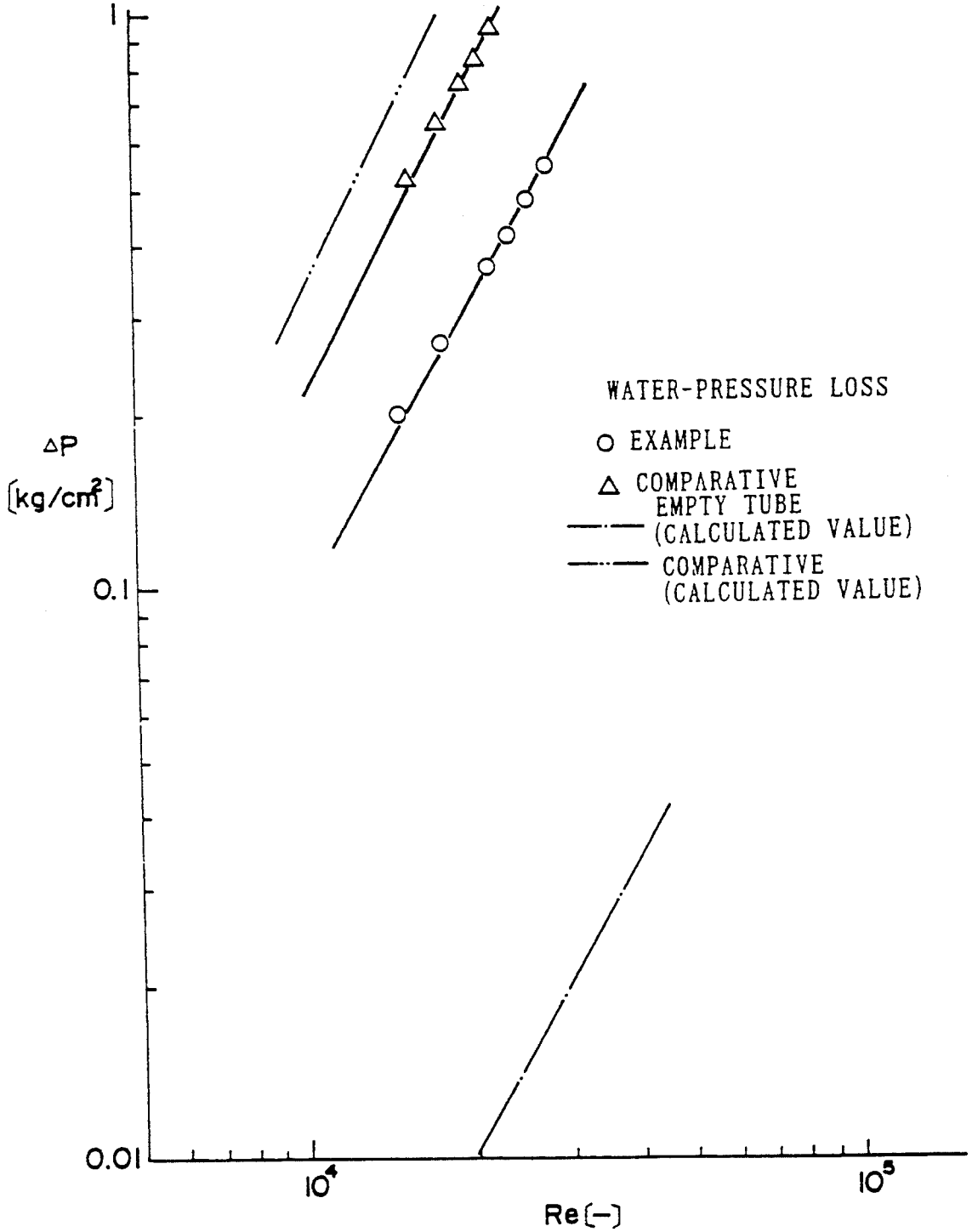
FIG. 6 is a graph showing the results of pressure losses with a low viscosity liquid (water).

FIG. 6 shows test results of the pressure losses with use of tap water. The pressure losses were lower with the present embodiment than those with the Comparative Example, demonstrating a highly fluid structure of the inventive Embodiment.

(3-2) Heating Tests by Low-Viscosity Liquids

Figure 7:
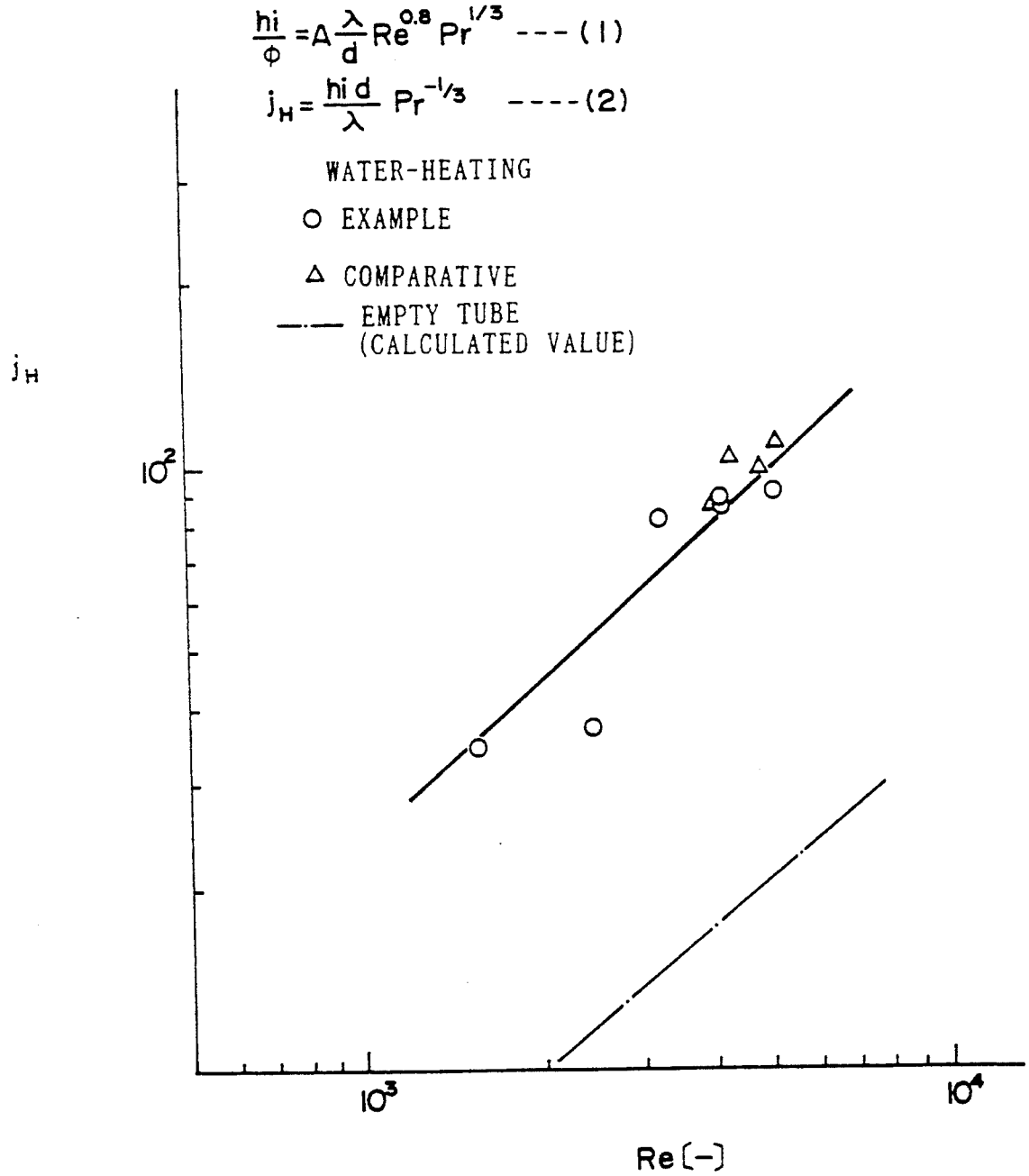
FIG. 7 is a graph showing the results of heating tests with a low viscosity liquid (water).

FIG. 7 shows results of a tap water heating test with steam. $j_H$ is given by formula (2) (see Note 1). It is seen that, with a low-viscosity liquid, such as tap water, no significant difference is produced in the thermal efficiency between the Embodiment and the Comparative Example.

(3-3) Pressure Losses by High Viscosity Liquids

Figure 8:
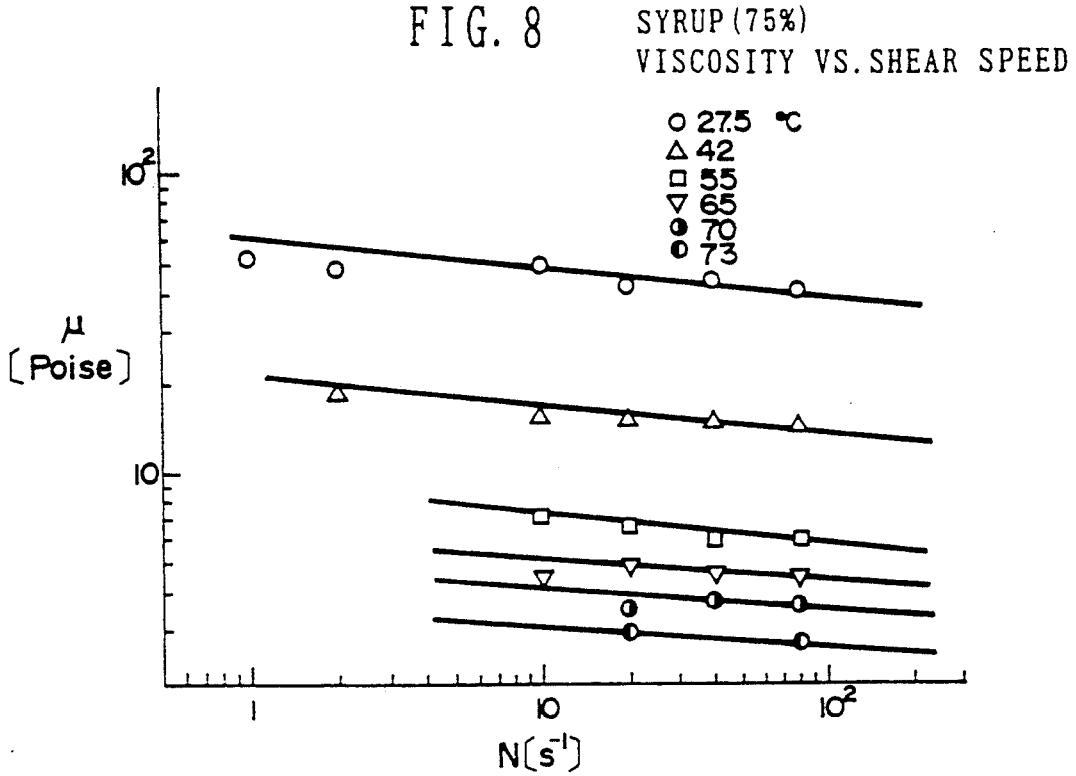
FIGS. 8 and 9 are graphs showing the relationship between the viscosity and shear rate and that between the viscosity and the temperature of a syrup as a high viscosity liquid.
Figure 9:
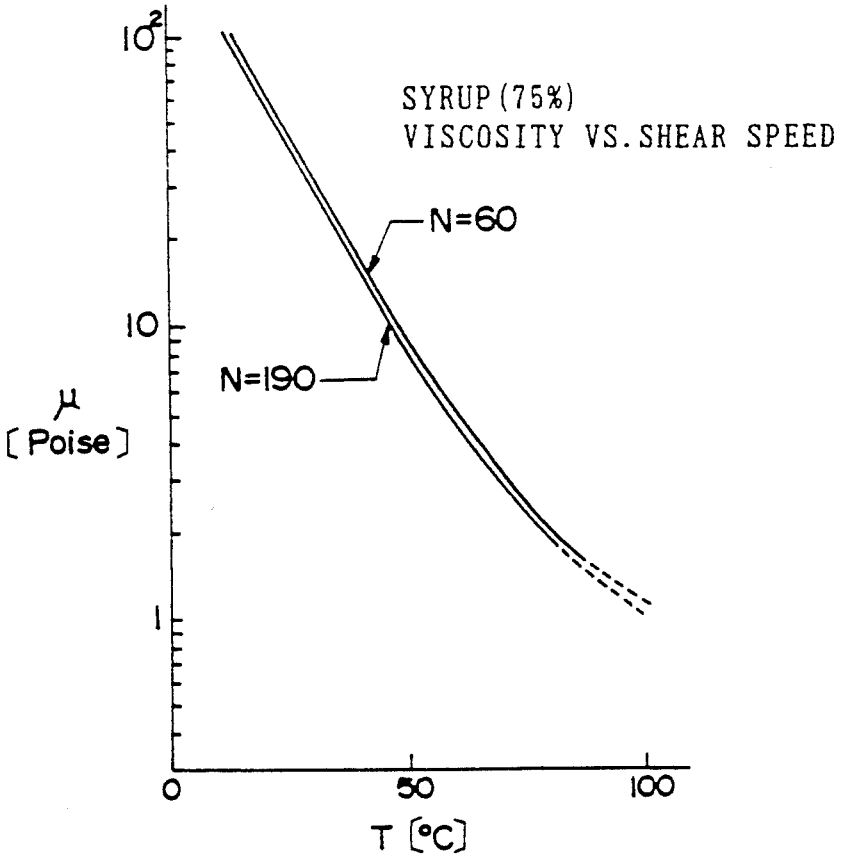

FIGS. 8 and 9 show measured results of the viscosity versus shear speed and viscosity versus temperature of starch syrup, adjusted to a concentration of 75%, respectively. It is seen that, in the present test, the shear rate N is in a range of from 40 to 200 $S^{-1}$, and that, while the viscosity is affected to a lesser extent as long as this range of the shear rate is concerned, the temperature represents a significant influencing factor.

Figure 10:
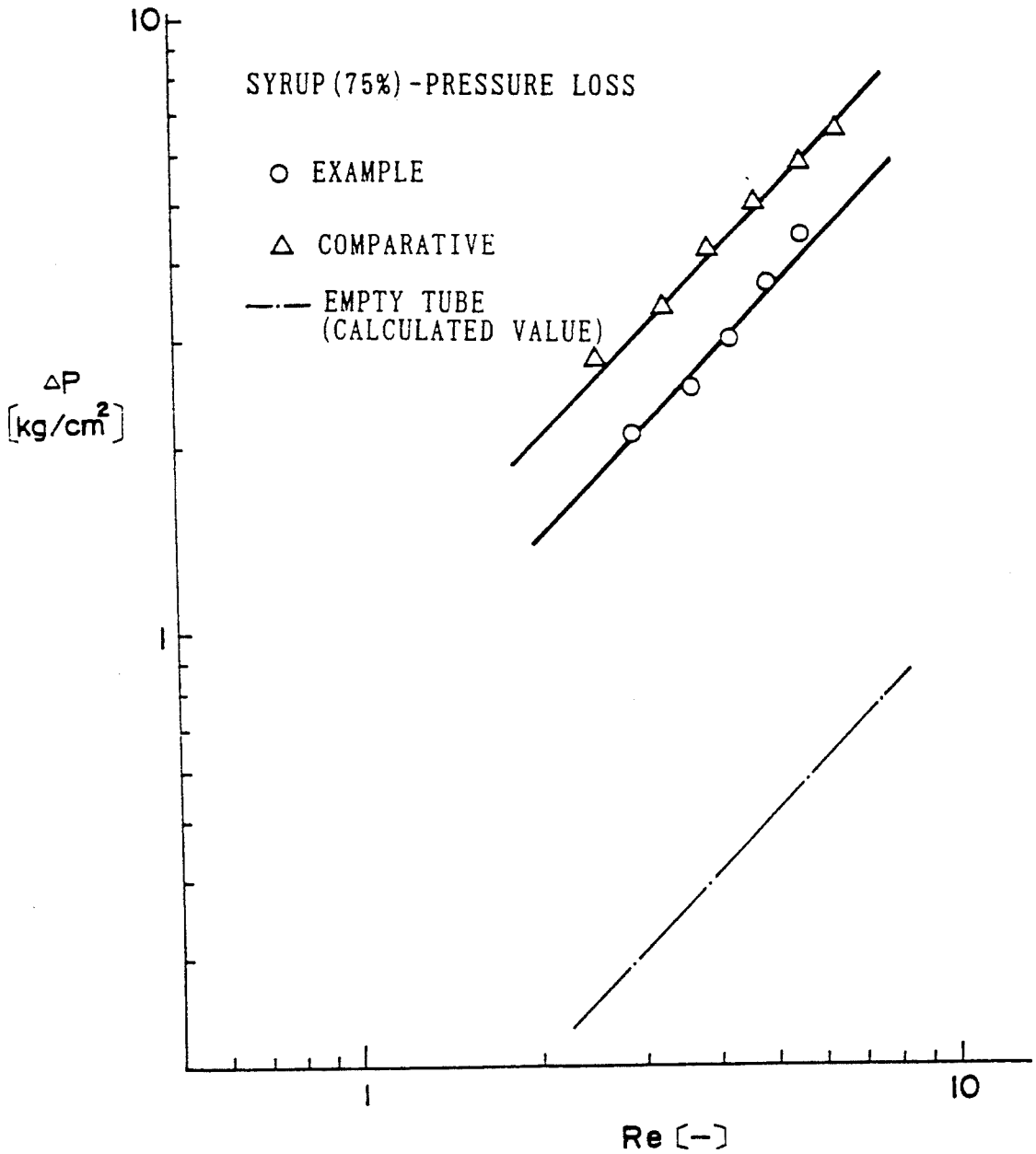
FIGS. 10 and 11 are graphs showing the results of pressure losses by a high viscosity liquid.

FIG. 10 shows test results on the pressure losses with the use of syrup. The results of the pressure losses obtained with the highly viscous fluid such as syrup were within acceptable level as compared to those obtained with tap water.

Figure 11:
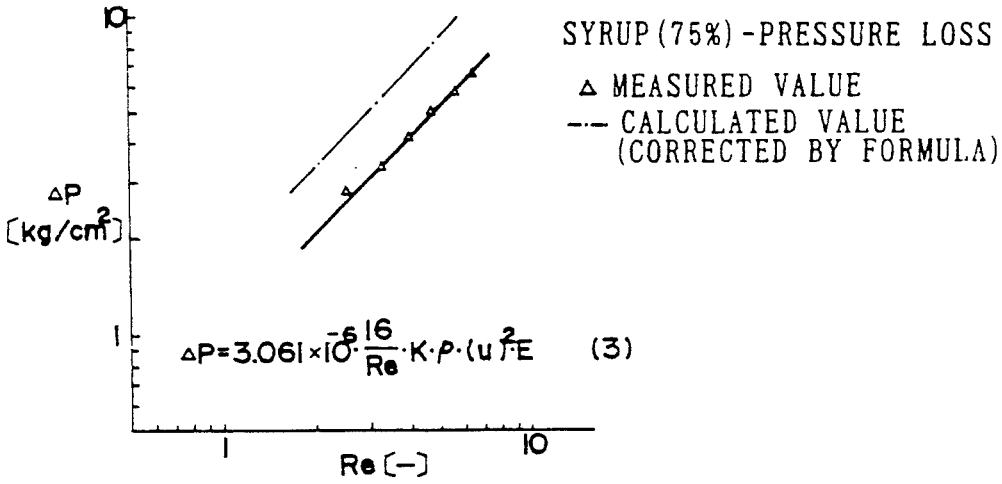

FIG. 11 shows, for comparison sake, the test results and estimated values of the pressure losses of the Comparative Example. The estimated values are found from the formula (3) (see Note 1). The pressure loss obtained from the actual viscosity is different from that estimated from the general formulae. Therefore, adjustment would be required for calculating the Reynolds number.

(3-4) Heating Test with Highly Viscous Liquid

Figure 12:
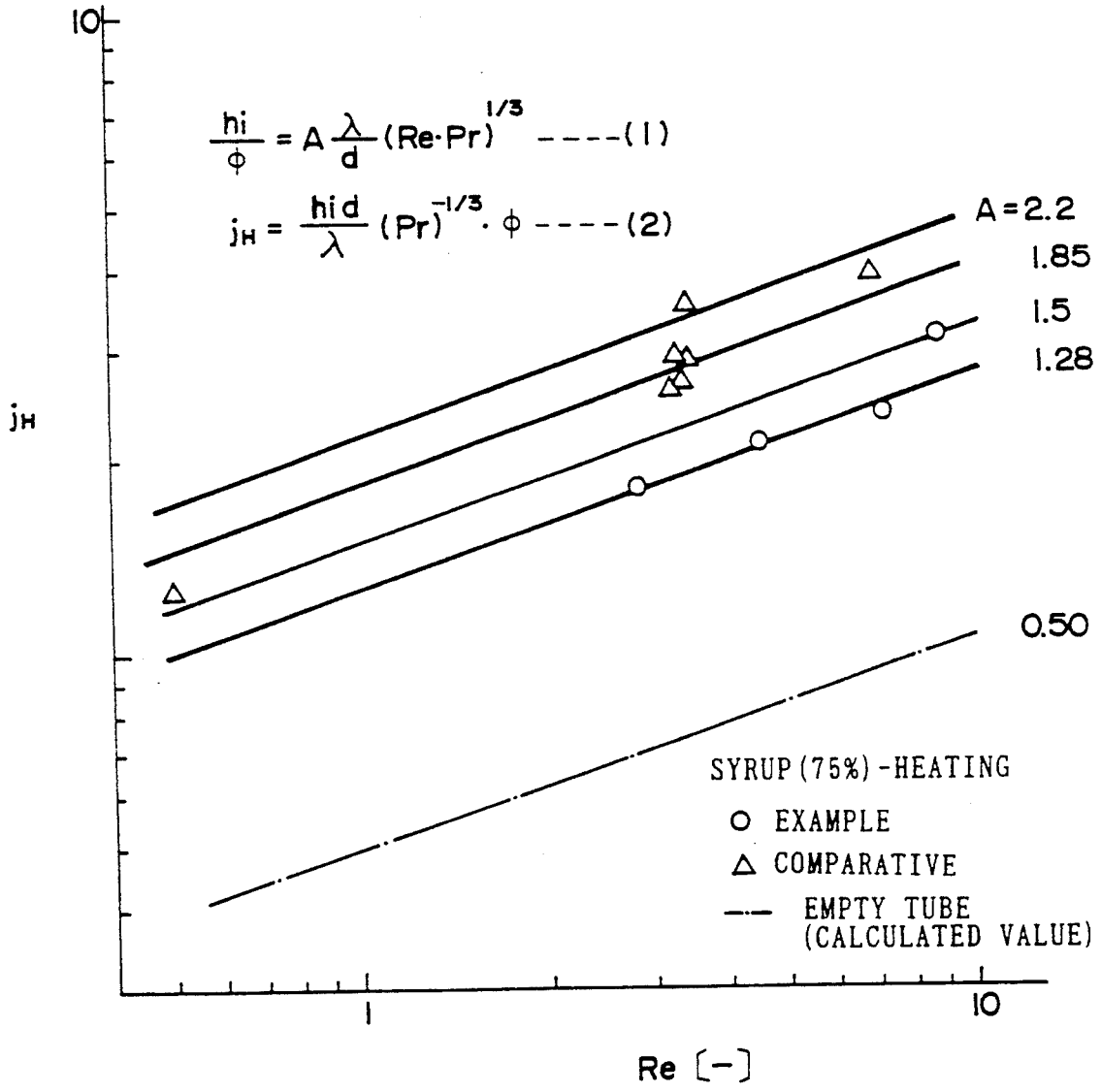
FIG. 12 is a graph showing the results of a heating tests with a high viscosity liquid.

FIG. 12 shows the results of the starch syrup heating test with steam. The heat transfer coefficient hi on the inside of the tube is given by the formula (1) (see Note 1) where $\phi = 1.1$. With the embodiment of the present invention, the heat transfer coefficient hi is proportional to a power of one-third of Re, as with the Comparative Example. The coefficient A was 1.85 for the Comparative Example, while being 1.28 for the embodiment of the invention. It was seen that the thermal efficiency was slightly better in the case of the Comparative Example.

(3-5) Cooling Test with Highly Viscous Liquid

Figure 13:
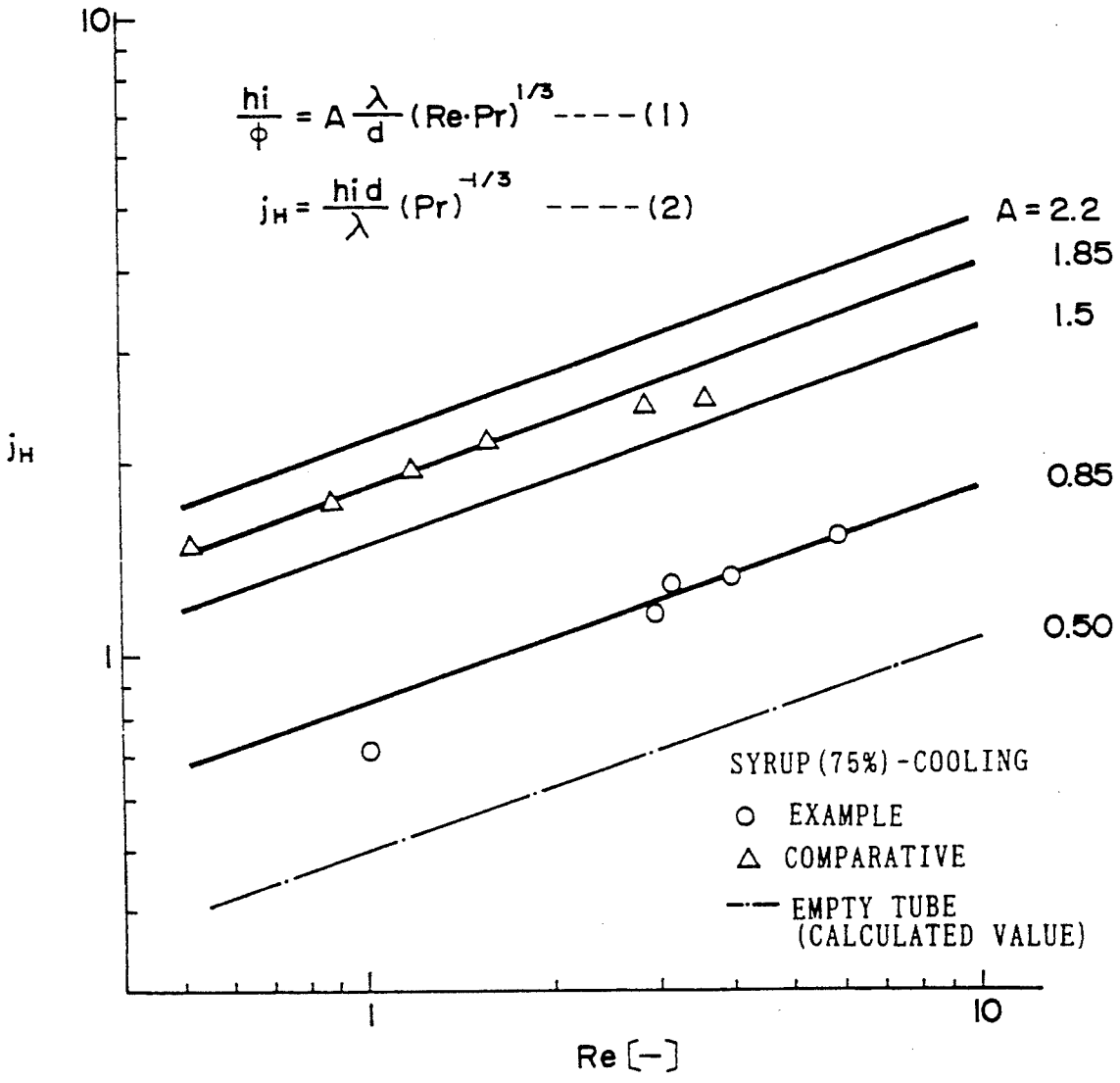
FIG. 13 is a graph showing the results of a cooling tests with a high viscosity liquid.

FIG. 13 shows the results of the cooling test with tap water. Similar results to those of the heating test were obtained with the Comparative Example. With the embodiment of the present invention, A=0.85, so that the thermal efficiency was lower than that upon heating.

TABLE 1

| | |
|---|---|
| Type | STHE-0.2A(4)/S |
| Heat transfer area | 0.2 $m^2$ |
| Inner tube | $\frac{1}{2}^B$ Sch40 (I.D16.1$\phi$, four, 32 el/per tube) |
| Outer tube | $2\frac{1}{2}^B$ Sch20 (I.D69.3$\phi$) |
| Effective length | 810 mm |

TABLE 2

Figure 4:
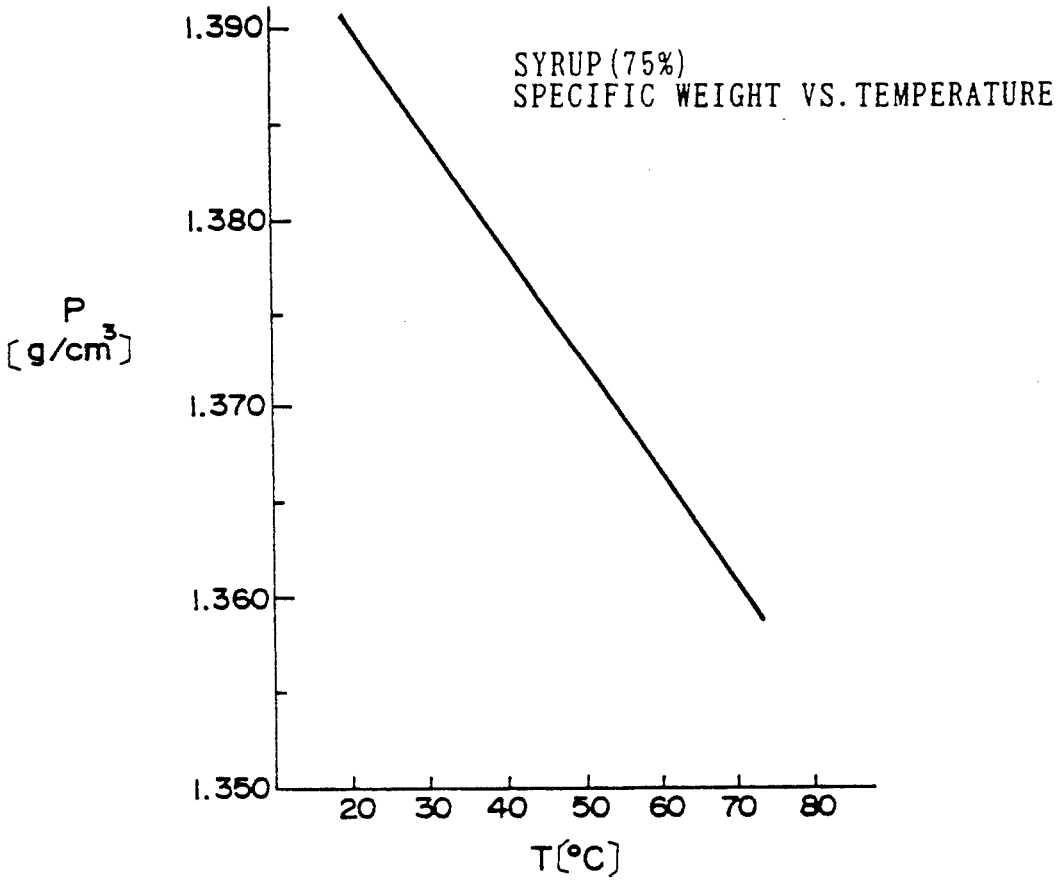
FIGS. 4 and 5 are graphs showing characteristics (specific gravity and specific heat) of a syrup as a high viscosity liquid.
Figure 5:
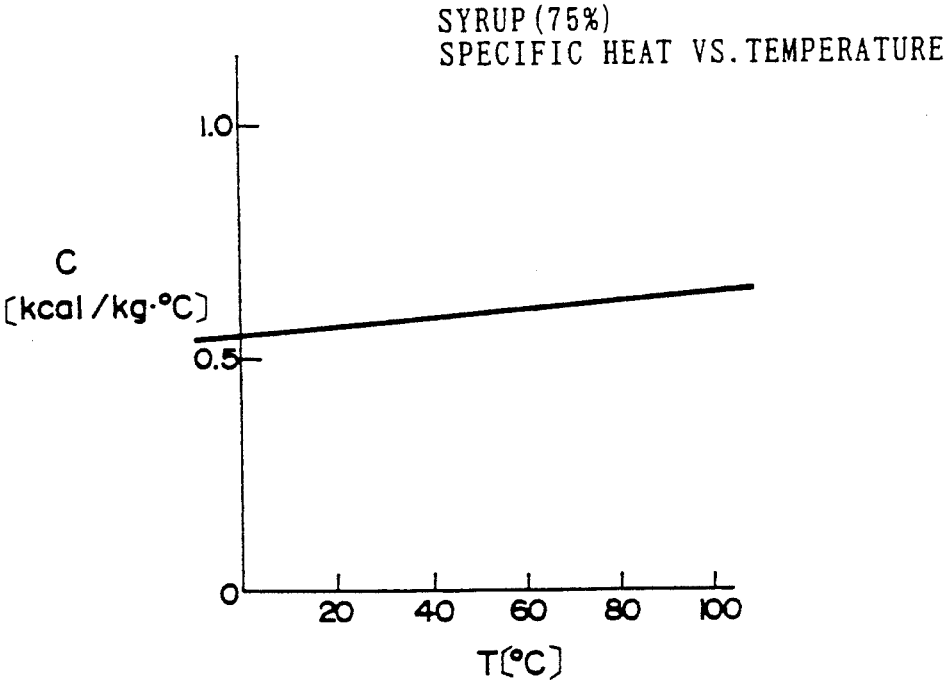

| Physical Properties | Fluids | | |
|---|---|---|---|
| | Water | steam | Starch syrup |
| $\rho$ [kg/m$^3$] | 1000 | 960 | FIG. 4[2)] |
| $\mu$ [Poise] | 0.01 | 0.00145 | — |
| $\lambda$ [kcal/m · h · °C.] | 0.52 | 0.59 | 0.3[1)] |
| c [kcal/kg · °C.] | 1.0 | — | FIG. 5[2)] |

TABLE 2-continued

| Physical Properties | Fluids | | |
|---|---|---|---|
| | Water | steam | Starch syrup |
| r [m · h · °C./kcal][3)] | 0.0001 | 0.0001 | 0.0001 |

[1)]Estimated value

[2)]Data by Technical Service of NIPPON CORN STARCH CO., LTD.

[3)]Suffix numerals 0 and 1 indicate the outer and inner sides of the tube, respectively. As for water heating with the Embodiment of the invention, $r_0 = r_1 = 0$.

(4) Results (4-1) Pressure Losses

As for the pressure losses, the following results were obtained.

(i) Low-viscosity liquid (water) $Re > 10^4$

ΔP (Embodiment)/ΔP (Comparative Example)=0.40 to 0.45.

(ii) High-viscosity liquid (starch syrup) $Re < 10$

ΔP (Embodiment)/ΔP (Comparative Example)=0.70 to 0.75.

(4-2) Heat Exchange Efficiency [$j_H$] (Note 2)

As for the heat exchange efficiency, the following results were obtained.

(i) Low-viscosity liquid (water)-steam heating $Re > 10^3$ $j_H$ (Embodiment)/$j_H$ (Comparative Example)≈1.0

(ii) High-viscosity liquid (starch syrup) $Re < 10$

Steam Heating $j_H$(Embodiment)/$j_H$(Comparative Example)≈0.70 cooling $j_H$(Embodiment)/$j_H$(Comparative Example)≈0.50

(5) Scrutiny

The pressure losses of the heat exchanger of the embodiment of the present invention are not more than 0.75 times (not more than 0.45 times for low-viscosity liquids) those of that of the Comparative Example.

With the heat exchanger of the present embodiment, if used for a steam heating system for a low viscosity fluid, such as water, a heat transfer efficiency comparable to that of the Comparative Example, can be achieved. The heat exchanger of the present embodiment may also be employed with a high viscosity fluid taking account of its simplified structure and low pressure losses which can be achieved with the present heat exchanger.

(Note 1) Formulas (1), (2) and (3)

$$\frac{h_i}{\Phi} = A \cdot \frac{\lambda}{d} \cdot (Re \cdot Pr)^{\frac{1}{3}} \quad (1)$$

$$j_H = \frac{h_i\, d}{\lambda} \cdot (Pr)^{-\frac{1}{3}} \quad (2)$$

$$\Delta P = 3.061 \times 10^{-6} \cdot \frac{16}{Re} \cdot K \cdot \rho \cdot (u)^2 \cdot E \quad (3)$$

(Note 2) Sequence of Calculation of Heat Transfer Coefficient

-continued $$\frac{1}{U} = \frac{1}{h_i} \cdot \frac{D_i}{D_o} + \frac{1}{h_o} + \frac{b}{k_w} \cdot \frac{D_o}{D_m} + r_i \frac{D_i}{D_o} + r_o \quad (I)$$

Symbols:

$h_i$: film coefficient of heat-transfer inside tube (kcal/m$^2$ · h · °C.)
$h_o$: film coefficient of heat-transfer outside tube (kcal/m$^2$ · h · °C.)
λ: thermal conductivity of fluid (kcal/m · h · °C.)
$j_H$: heat exchange efficiency
$d$: outer diameter of heat exchanger tube (m)
$D_i$: inner diameter of heat exchanger tube (m)
$D_o$: outer diameter of heat exchanger tube (m)
$r_i$: fouling factor inside tube (m$^2$ · h · °C./kcal)
$r_o$: fouling factor outside tube (m$^2$ · h · °C./kcal)
$k_w$: thermal conductivity of heat exchanger tube (kcal/m · h · °C.)
$b$: thickness of heat exchanger tube (m)
$D_m$: mean diameter of heat exchanger tube (m)
$E$: number of elements
$K$: pressure loss coefficient
Φ: shape factor
$P_r$: Prandtl number
$R_e$: Reynolds number
$A$: heat conducting area (m$^2$)
$U$: overall coefficient of heat transfer (kcal/m$^2$ · h · °C.)
$u$: flow rate (m/h)

HEATING

If the flow rate of a fluid inside the tube is given by W (kg/h), the heat exchange quantity Q (kcal/h) is given by:

$$Q = W \cdot C \cdot \Delta t \text{ (C: specific heat)} \quad (II)$$

Based on a table for saturated steam, the enthalpy h (kcal/kg) is read from a steam secondary pressure, and a steam flow rate W' (kg/h) is found by the following formula:

$$W' = Q/h \quad (III)$$

In addition, an overall heat transfer coefficient U (kcal/m$^2$·h·°C.) is found from the following formula $$U = Q/A \cdot \Delta tm \text{ (}\Delta tm\text{: logarithmic mean temperature difference)} \quad (IV)$$

and $h_1$ is calculated from formula (I). Then, $j_H$ is obtained from the formula (2). However, $h_o$ is to be obtained using a formula for calculation.

COOLING

The flow rate of the cooling water W (kg/h) is measured and $h_i$ is obtained following the same procedure as that used for the case of steam heating.

It should be noted that modification obvious in the art can be made according to the present invention without departing the gist and scope as disclosed herein and claimed in the appended claims.

What is claimed is:

1. A heat exchanger tube, comprising a spiral element extending longitudinally within a tube, said spiral element comprising a plurality of unit elements connected together successively end-to-end with a connection angle of 0°, and each of said unit elements having a twist angle of 180°, with the direction of the twist being reversed from one unit element to a neighboring unit element.

2. The heat exchanger tube as defined in claim 1 wherein the inner wall of the inner tube and the spiral elements are connected together by brazing.

3. The heat exchanger tube as defined in claim 1 in which the unit element has a ratio L/D of 1 to 3 where L represents the longitudinal length of the unit element and D represents the inner diameter of the tube.

4. The heat exchanger tube as defined in claim 1, wherein said spiral element comprises at least 32 unit elements.

5. A heat exchanger, comprising an outer tube, at least one inner tube disposed within said outer tube, and a spiral element extending longitudinally within said inner tube, said spiral element comprising a plurality of unit elements connected together successively end-to-end with a connection angle of 0°, and each of said unit elements having a twist angle of 180°, with the direction of the twist being reversed from one unit element to a neighboring unit element.

6. The heat exchanger as defined in claim 5 wherein the inner wall of the inner tube and the spiral element are connected together by brazing.

7. The heat exchanger as defined in claim 5 in which the unit element has a ratio L/D of 1 to 3 where L represents the longitudinal length of the unit element and D represents the inner diameter of the tube.

8. The heat exchanger as defined in claim 5 further comprising a heat exchange medium having a low viscosity liquid with a Reynolds number Re greater than $10^4$.

9. The heat exchanger as defined in claim 5, wherein said spiral element comprises at least 32 unit elements.

* * * * *